United States Patent [19]

Boykin

[11] 4,148,199

[45] Apr. 10, 1979

[54] PIERCED EARRING WITH LIQUID VISIBLE THEREIN

[76] Inventor: John D. Boykin, 4158 Eastview Ave., Lake Worth, Fla. 33460

[21] Appl. No.: 789,817

[22] Filed: Apr. 22, 1977

[51] Int. Cl.[2] ..... A44C 7/00

[52] U.S. Cl. ..... 63/12; 63/31; 272/8 N

[58] Field of Search ..... 63/12, 13, 29 R, 31, 63/32; 272/8 N, 9

[56] References Cited

U.S. PATENT DOCUMENTS

| | | | |
|---|---|---|---|
| 119,530 | 10/1871 | Northrup | 63/12 |
| 758,848 | 5/1904 | Pejchar | 63/12 |
| 1,912,602 | 6/1933 | Stonberg | 63/32 |
| 2,976,039 | 3/1961 | Chouinard | 272/8 N |

FOREIGN PATENT DOCUMENTS

| | | | |
|---|---|---|---|
| 40085 | 12/1909 | Austria | 63/12 |
| 1117966 | 6/1968 | United Kingdom | 63/12 |

*Primary Examiner*—F. Barry Shay
*Attorney, Agent, or Firm*—Daniel Jay Tick

[57] ABSTRACT

An earring has two transparent enclosures, each shaped as half a dog bone. Each of the enclosures has a cavity with a colored liquid therein. Caps at the open ends of the enclosures seal the liquids therein. A shank extending from one of the caps has an internally threaded axial bore formed therein and threadedly coupleable with an externally threaded shank extending from the other cap so that the earring is securable to a pierced ear.

6 Claims, 2 Drawing Figures

PIERCED EARRING WITH LIQUID VISIBLE THEREIN

BACKGROUND OF THE INVENTION

The present invention relates to an ornamental earring.

The ornamental earring of the invention utilizes transparent material such as glass. Part of the female component extends through a pierced ear of the user and part of the male component is threadedly coupled to the female component. The components contain colored water of any color, which is preferably red, blue or pink. The earring of the invention gives the impression of a bone filled with a fluid and passing through the ear of the user. Furthermore, a complete set of up to approximately twelve colored pairs of earrings may be provided for a woman to wear in conjunction with different colored garments.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
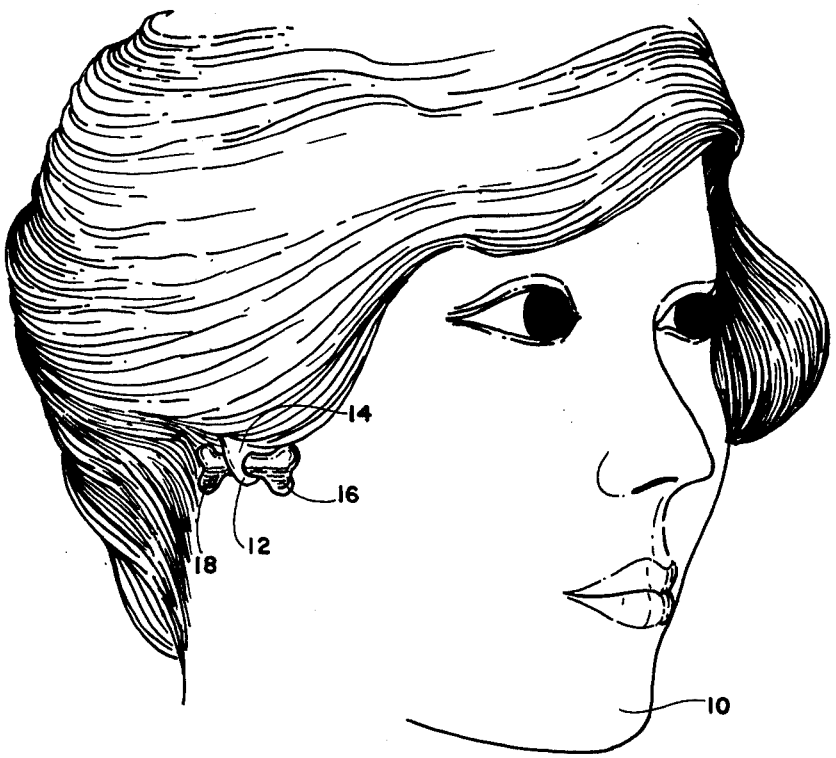
FIG. 1 is a perspective view of an ornamental earring of the invention in use.
Figure 2:
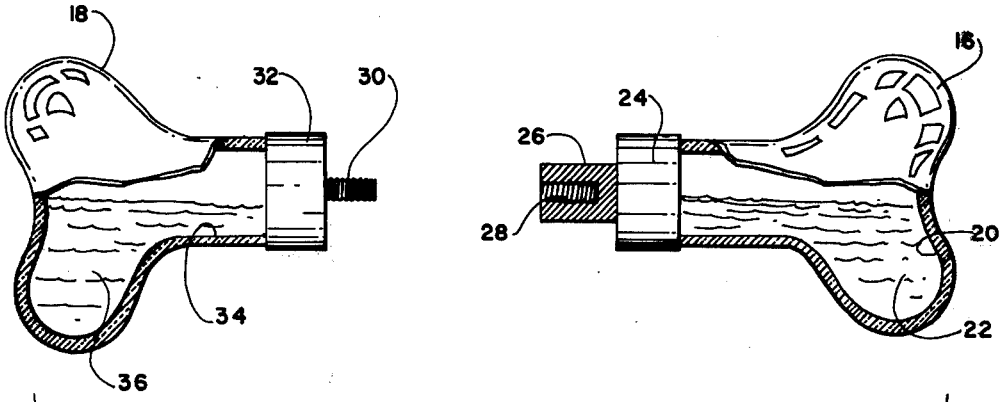
FIG. 2 is a view, on an enlarged scale, partly cut away and partly in section, of both components of the ornamental earring of the invention.

The ornamental earring of the invention comprises a male component having a transparent enclosure 18 formed in the shape of half a dog bone, as shown in FIGS. 1 and 2. The enclosure 18 has a cavity 34 with a liquid 36 therein (FIG. 2).

A female component has a transparent enclosure 16 formed in the shape of the other half of the dog bone, as shown in FIGS. 1 and 2. The enclosure 16 has a cavity 20 with a liquid 22 therein (FIG. 2).

The level of the liquid 36 and 22 in each of the components is equal to that in the other, and is colored. The color of the liquid 22 is the same as that of the liquid 36.

The enclosures 18 and 16 preferably consist of clear glass.

The male and female components have cooperating coupling devices, shown in FIG. 2, for removably coupling them to each other through the hole 12 of a pierced ear 14 of a user 10 in a manner whereby said components appear to be a dog bone passing through said ear, as shown in FIG. 1.

The enclosure 18 of the male component has an open end with a cap 32 (FIG. 2) secured to said enclosure at said open end for sealing the liquid 36 in said enclosure.

An externally threaded shank 30 extends from the cap 32, as shown in FIG. 2.

The enclosure 16 of the female component has an open end with a cap 24 (FIG. 2) secured to said enclosure at said open end for sealing the liquid 22 in said enclosure. A shank 26 extends from the cap 24 and has an internally threaded axial bore 28 formed therein for threaded coupling to the shank 30 of the male component.

The shank 26 is preferably extended through the hole 12 of the ear 14 and the shank 30 is then threadedly coupled in the bore 28 of the shank 26.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An ornamental earring, comprising a male component having a transparent enclosure formed in the shape of half an elongated element and defining a cavity only partially filled with a visible liquid; and a female component having a transparent enclosure formed in the shape of the other half of the element and defining a cavity only partially filled with a visible liquid similar to the first liquid, said male and female components having cooperating coupling means for removably coupling them to each other through a pierced ear of a user in a manner whereby said components appear to be an elongated liquid-containing element passing through the user's ear.

2. An ornamental earring as claimed in claim 1, wherein the level of the liquid in each of the components is equal to that in the other.

3. An ornamental earring as claimed in claim 2, wherein the liquid in the components is colored.

4. An ornamental earring as claimed in claim 3, wherein the enclosure of each of the components consists of glass.

5. An ornamental earring as claimed in claim 4, wherein the enclosure of the male component has an open end, a cap secured to the enclosure of the male component at the open end thereof for sealing the liquid in said enclosure, and an externally threaded shank extending from said cap.

6. An ornamental earring as claimed in claim 5, wherein the enclosure of the female component has an open end, a cap secured to the enclosure of the female component at the open end thereof for sealing the liquid in said enclosure, and a shank extending from said cap and having an internally threaded axial bore formed therein for threaded coupling to the shank of said male component.

* * * * *